United States Patent [19]

Nakamura

[11] Patent Number: 4,668,198

[45] Date of Patent: May 26, 1987

[54] POWER SWITCHING APPARATUS OF OUTBOARD ENGINES

[75] Inventor: Daisuke Nakamura, Shizuoka, Japan

[73] Assignee: Suzuki Jidosha Kogyo Kabushiki Kaisha, Shizuoka, Japan

[21] Appl. No.: 750,094

[22] Filed: Jun. 28, 1985

[30] Foreign Application Priority Data

Jul. 6, 1984 [JP] Japan ..... 59-138935
Dec. 5, 1984 [JP] Japan ..... 59-183580[U]

[51] Int. Cl.[4] ..... B63H 21/24
[52] U.S. Cl. ..... 440/75; 440/86
[58] Field of Search ..... 440/75, 86; 91/378, 91/377, 376; 192/21, 93 R; 74/335, 378, 388

[56] References Cited

U.S. PATENT DOCUMENTS 2,728,320 12/1955 Kloss ..... 440/86
3,818,855 6/1974 Shimanckas ..... 440/75
3,919,964 11/1975 Hagen ..... 440/75

*Primary Examiner*—Joseph F. Peters, Jr.
*Assistant Examiner*—Jesûs D. Sotelo
*Attorney, Agent, or Firm*—Bruce L. Adams; Robert E. Burns; Emmanuel J. Lobato

[57] ABSTRACT

In a power switching apparatus of an outboard engine wherein a shifter dog is moved by a shift cam to engage with a forward gear or a reverse gear for rotating a propeller of a boat in the forward or rearward direction, there is provided a clutch mechanism interposed between a shift rod connected to the shift cam and a clutch rod. The clutch mechanism comprises a clutch housing, the diameter of the intermediate portion of an inner opening of the housing being reduced. The housing is formed with large diameter openings at its upper and lower portions. The clutch mechanism further comprises spring housings respectively fitted in the large diameter portions, a plunger with its large diameter portions at the upper and lower ends fitted in the spring housings respectively, shift springs interposed between the inner bottoms of respective spring openings and the large diameter portions of the plunger, locking balls for locking and unlocking the spring housings with the plunger, and detent mechanism for positioning the spring housings in the neutral position whereby the shift cam is moved through the shift spring when the shifter dog engages with the gears, whereas the shift cam is moved integrally with the clutch rod through the spring housings and the plunger when the shifter dog disengages from the gears.

19 Claims, 9 Drawing Figures

POWER SWITCHING APPARATUS OF OUTBOARD ENGINES

BACKGROUND OF THE INVENTION

This invention relates to power switching or transmission apparatus of an outboard engine, and more particularly to power switching apparatus of an outboard engine capable of improving the follow up characteristic and the operating feeling of the switching mechanism at the time of switching the power.

As shown in FIG. 5, in a prior art switching mechanism utilized to switch a forward rotation condition (forward advance), a reverse rotation condition (rearward advance) and a neutral condition of a propeller, a shift cam 2 is moved by the vertical or axial operation of a shift rod 1 to select one of the forward position F, neutral position N and reverse position R formed on the surface of the cam 2. The shift cam 2 moves a shifter dog 6 through a dog pin 5 by pushing a push rod 3 or the shifter dog 6 returns to the neutral position by the force of a return spring 4 so as to cause the dog 6*a* of the shifter dog 6 to engage with the dogs 7*a* or 8*a* of a forward gear 7 or a reverse gear 8, or to cause the dog to assume the neutral position in which the dog 6*a* does not engage with the dogs 7*a* and 8*a*. When dog 6*a* engages with one of the dogs 7*a* and 8*a* of gears 7 and 8, the drive shaft 9 rotates a propeller shaft 10 in the forward or reverse direction through the gear 7 or 8.

In the power switching mechanism of the prior art outboard engine having a construction as above discribed, there is a defect that as the shift cam 2 is moved from the neutral position N to the reverse position R to cause the shifter dog 6 to engage with the reverse gear 8, if the operating speed of the shift cam 2 is low, the corner portions of the dogs 6*a* and 8*a* are subjected to an impact force when engagement of the shifter dog 6 and the reverse gear 8 is shallow whereby these portions are worn to decrease the operating feeling.

There is another defect that when the shift cam 2 is brought to the neutral or forward position, as the number of revolution of the engine is increased while the shift cam 2 is being set at the reverse position, the shifter dog 6 would be moved to the neutral position or the forward position by the force of the return spring 4, but at this time since the contact pressure caused by the engagement of the shifter dog 6 and the dog 8*a* of the reverse gear 8 is high, there arises a case wherein the force of the return spring 4 can not move the shifter dog 6. For this reason, the mechanism has been constructed such that the angle of engagement between dogs 6*a* and 8*a* becomes positive so as to push the shifter dog 6 toward the neutral position. With this construction, however, it takes a certain time until the shifter rod 6 returns to the neutral position. Furthermore, this time is delicately influenced by the coarseness of the dog surface so that the return time is not constant. If the positive angle is made too large, the wear is accelerated by the slip between the shift cam 2 and the push rod 3.

To obviate the first mentioned defect it has been proposed a construction shown in FIG. 6 in which the intermediate portion of the shift rod is constructed to freely contract and expand by interposing a spring 11. According to this improvement, a detent mechanism 12 is engaged with the cam 2 for rapidly moving the shifter dog 6 from the neutral position to the reverse position by the force of spring 11 regardless of the operating speed of the shift rod 1. With this improvement, however, not only the second defect can not be solved but also a problem similar to the second defect occurs. These defects also occur when a rotary cam 2' as shown in FIG. 7 is used instead of the shift cam 2 which is moved linearly.

SUMMARY OF THE INVENTION

It is an object of this invention to provide an improved power switching apparatus of an outboard engine capable of eliminating the defects of the prior art mechanisms.

According to this invention, there is provided power switching apparatus of an outboard engine wherein a shifter dog is moved by a shift cam to engage with a forward gear or a reverse gear and to disengage therefrom at a neutral position for transmitting the rotation of a drive shift to a propeller shaft to rotate it in a forward or rearward direction. The apparatus is characterized in that there is provided a clutch mechanism interposed and flexibly connected between a shift rod connected to the shift cam and a clutch rod. The clutch mechanism includes a clutch housing, the diameter of an intermediate portion of the inner opening of the housing being reduced. The housing is formed with large diameter openings at its upper and lower portions. Spring housings are respectively fitted in the large diameter portions of the clutch housing. A plunger has its large diameter portions at the upper and lower ends being fitted in the spring housings respectively. Shift springs are interposed between the inner bottoms of respective spring housings and the large diameter portions of the plunger. Locking balls are received in openings provided on the inner wall of the spring housings and are free to engage with and disengage from grooves provided on the larger diameter portions of the plunger. A detent mechanism is provided to position the spring housings to the neutral position. By such a construction, the shift cam is moved through the shift springs when the shifter dog engages with the forward gear and rearward gear of the propeller shaft, while the shift cam is moved integrally with the clutch rod through the housings and the plunger when the shifter dog disengages from the forward gear and the reverse gear.

DESCRIPTION OF THE PREFERRED EMBODIMENT

Figure 1:
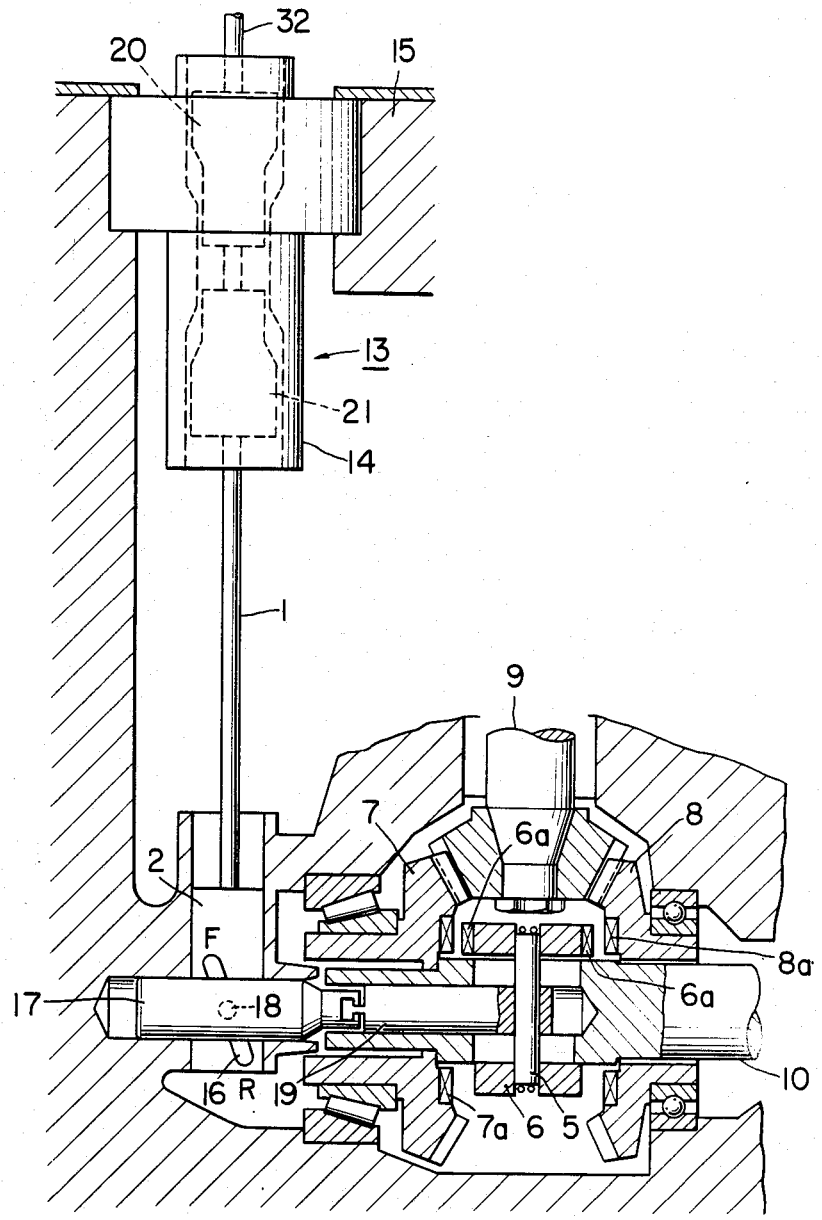
FIG. 1 is a longitudinal sectional view showing one embodiment of the power switching apparatus according to this invention.

A conventional outboard engine will firstly be described with reference to FIG. 9. As shown, an engine 102 is mounted on the upper end portion of a drive shaft housing 101 and covered with a cover 103. A gear casing 104 is disposed on the lower end of the drive shaft housing 101, and a propeller 105 is driven by a power switching apparatus disposed in the gear casing 104 for driving a boat, not shown, in the forward or reverse direction.

Figure 9:
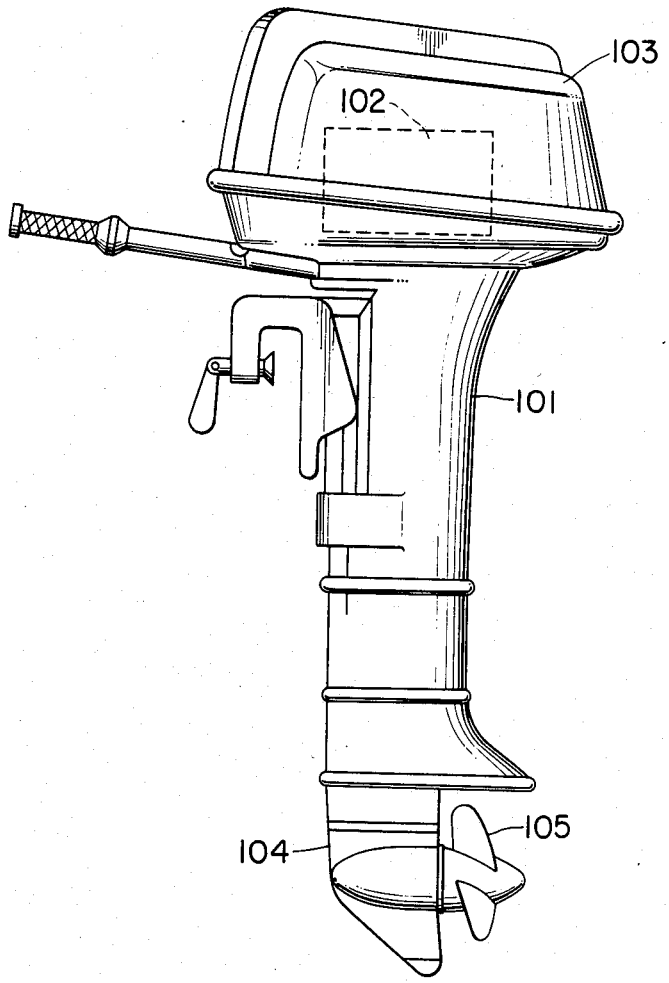
FIG. 9 is side view of one example of an outboard engine to which the invention is applicable.

Refering now to FIG. 1, a clutch mechanism or clutch means 13 is formed on the upper portion of a shift rod 1, and the housing 14 of the clutch mechanism 13 is secured to a casing 15 corresponding to the gear casing 104 shown in FIG. 9.

Figure 5:
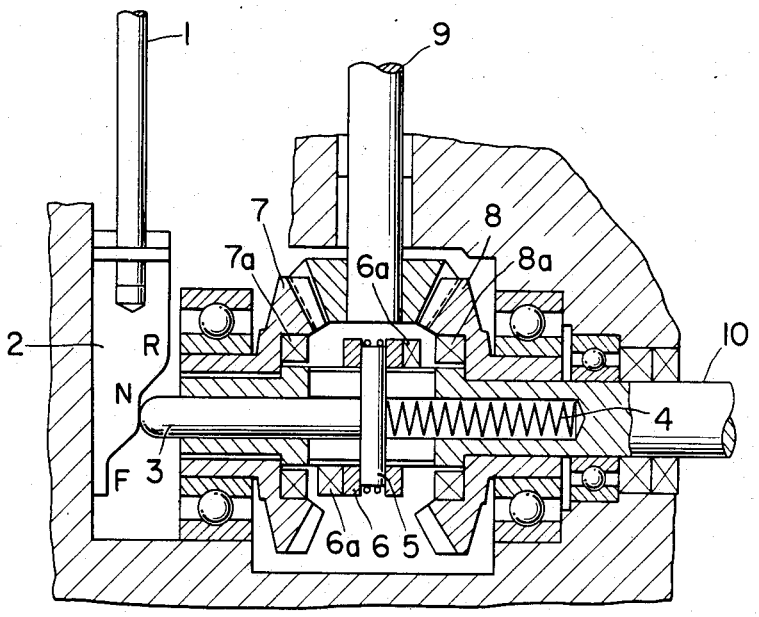
FIG. 5 PRIOR ART
FIG. 5 is a longitudinal sectional view of a prior art power switching mechanism.
Figure 6:
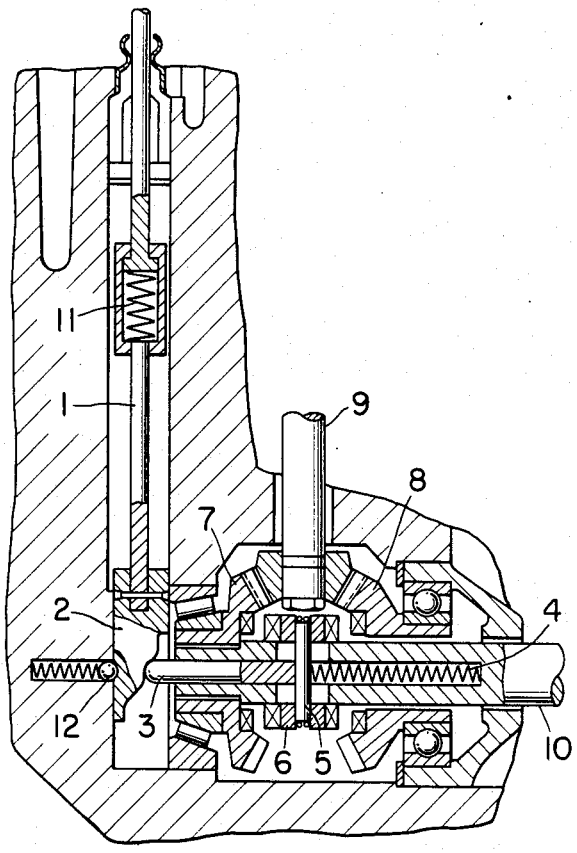
FIG. 6 PRIOR ART
FIG. 6 is a longitudinal sectional view showing another prior art power switching mechanism.
Figure 7:
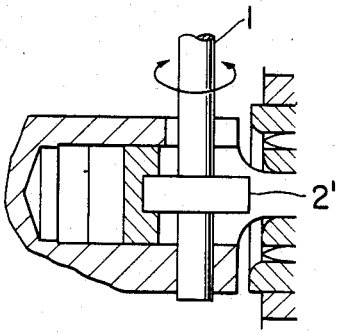
FIG. 7 PRIOR ART
FIG. 7 is a partial longitudinal sectional view showing another prior art shift cam.

A shift cam 2 secured to the lower end of the shift rod 1 is provided with an inclined groove or slot 16 adapted to receive a cross pin 18 of a slide shifter 17 slidably supported in a direction perpendicular to the direction of axial movement of the shift cam 2. A shifter dog 6 is connected to the slide shifter 17 via a slide pin 19 connected thereto, whereby the shifter dog 6 is directly coupled to or mechanically linked to the shift cam 2 and the slide shifter 17 so as to move the shifter dog 6 without providing the return spring 4 as in the prior art construction shown in FIG. 5.

Figure 2:
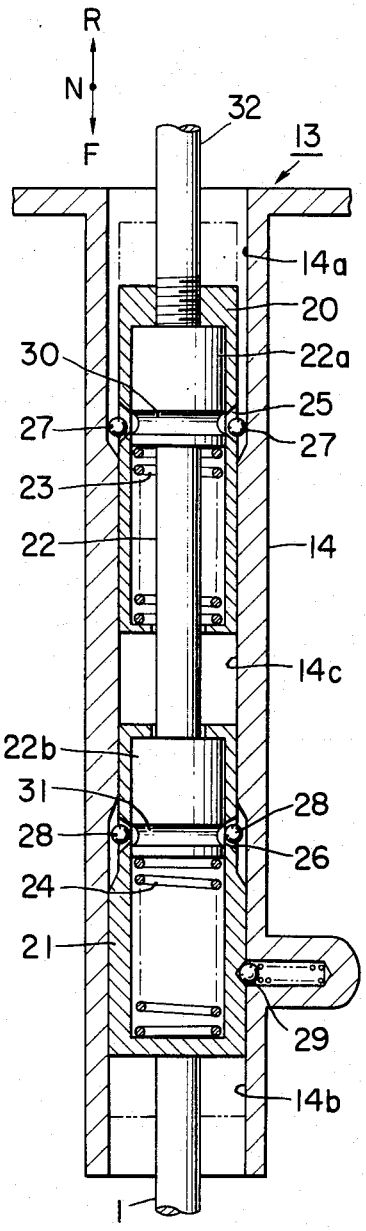
FIG. 2 is a longitudinal sectional view showing the clutch mechanism shown in FIG. 1 in the neutral position.

As shown in an enlarged sectional view in FIG. 2, the clutch mechanism 13 comprises a clutch housing 14, spring housings 20 and 21 respectively fitted or slidably and loosely disposed in the large diameter portions 14*a* and 14*b* provided at the upper and lower ends of the housing 14, a plunger 22 with its upper and lower large diameter portions 22*a* and 22*b* fitted or slidably disposed in the spring housings 20 and 21 respectively, springs 23 and 24 contained in the housings 20 and 21 for urging the plunger 22 upwardly, plunger locking balls 27 and 28, each having a diameter slightly larger than the wall thickness of the spring housings 20 and 21 and received in openings 25 and 26 provided on the spring housings 20 and 21, and a detent mechanism 29 for temporarily fixing the spring housing 21 in the neutral position or location. When the plunger locking balls 27 and 28 are positioned at the large diameter portions 14*a* and 14*b* of the clutch housing 14, the balls disengage from grooves 30 and 31 of the large diameter portions 22*a* and 22*b* of the plunger 22, whereas when the balls are positioned at the small diameter portion 14*c*, the balls engage with the grooves 30 and 31, and thus fasten the spring housings 20 and 21 to the plunger 22. A clutch rod 32 is connected to the upper end of the spring housing 20 and is axially and bidirectionally movable between a neutral position N, a forward position F, and rearward position R. Other elements shown in FIG. 1 are substantially identical to those shown in FIG. 5 so that they will not be described again.

The clutch mechanism shown in FIG. 2 operates as follows.

Figure 3:
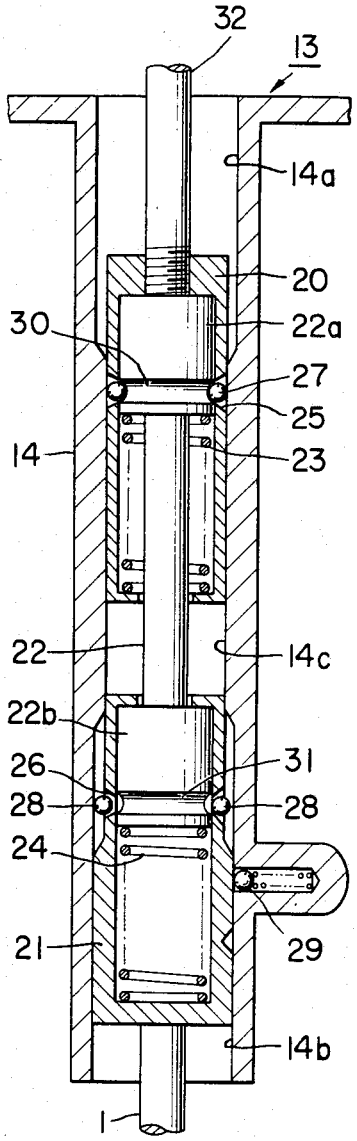
FIG. 3 is a longitudinal sectional view showing the same clutch mechanism in the forward position.
Figure 4:
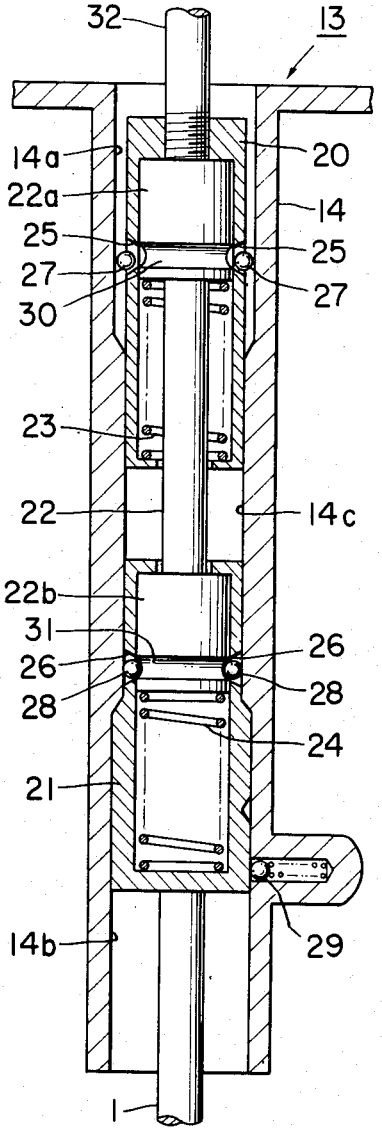
FIG. 4 is a longitudinal sectional view showing the clutch mechanism in the reverse position.

In FIG. 2, to move the boat in the forward direction by shifting the clutch rod from the neutral position N to the forward position F, the clutch rod 32 is depressed to push downward the plunger 22 via the spring housing 20. At this time, since the inner diameter of the clutch housing 14 is large, the plunger locking ball 28 does not engage with the groove 31 at the large diameter portion 22*b* of the plunger 22 so that the ball 28 can move freely with respect to the larger diameter portion 22*b* of the plunger 22. Thus the lower diameter portion 22*b* of the plunger 22 compresses the shift spring 24 against the shift rod 1 compresses the shift spring 24 against the shift rod 1 to store energy therein and to temporarily bias the shift rod 1 to store energy therein and to temporarily bias the shift rod 1. Accordingly, as shown in FIG. 3, when the force of the shift spring 24 becomes larger than that of the spring of the detent mechanism 29, the shift rod 1 is ensured to be strongly pushed downwardly by the biasing force of the spring 24. Consequently the shifter dog 6 shown in FIG. 1 engages with the dog 7*a* of the forward gear 7 at a high speed. Thus the dog 6 is smoothly meshed with the dog 7*a*. Even when the upper surfaces of the dogs 6*a* and 7*a* collide each other due to the flexure of the shift spring 24, there is a certain interval before the next meshing, so that there is no fear of applying undesirable impact force to the corner portions of the dogs. During this operation, the operating speed of the clutch rod 32 imposes no influence upon the operating speed of the shifter dog 6.

At the time when the clutch rod 15 returning to the neutral position N from the forward position F, as shown in FIG. 3, since the inner diameter of the housing 14*c* is small and closely receives the spring housing 20 existing between the positions N and F, the plunger locking ball 27 engages with the groove 30 of the large diameter portion 22*a* of the plunger 22 so that the spring housing 20 and the plunger 22 are connected integrally or fastened each other through the plunger locking ball 27. As a consequence, when the clutch rod 32 is pulled upwardly to return to the neutral position N from the forward position F, the plunger 22 is pulled up directly by the clutch rod 32 without the assist of the shift spring 23. At this time, since the plunger 22 and the spring housing 21 are also integrally connected together, the shift rod 1 is interlocked with and moved integrally with the clutch rod 32 so that the dog 6 is returned to the neutral condition in the coincidental response by the contact pressure between the dog 6 and the dog 7*a* of the forward gear 7 without staying on the gear side.

Similar operations are performed at the time when the dog is shifting to the reverse condition from the neutral condition, and vice versa.

As above described, according to this invention the shifter dog is meshed with a gear by utilizing pressure or biasing force stored in a spring, whereas the shifter dog is returned to a neutral position by disengaging the dog from the gear without utilizing the force of a return spring so that at the time of meshing, the gear would not strongly collide against the corner of the dog. Consequently, it is not only possible to prevent wear of the dog but also to improve operating feeling. Furthermore, the dogs are positively disengaged without interfering by the contact pressure between the dogs.

Figure 8:
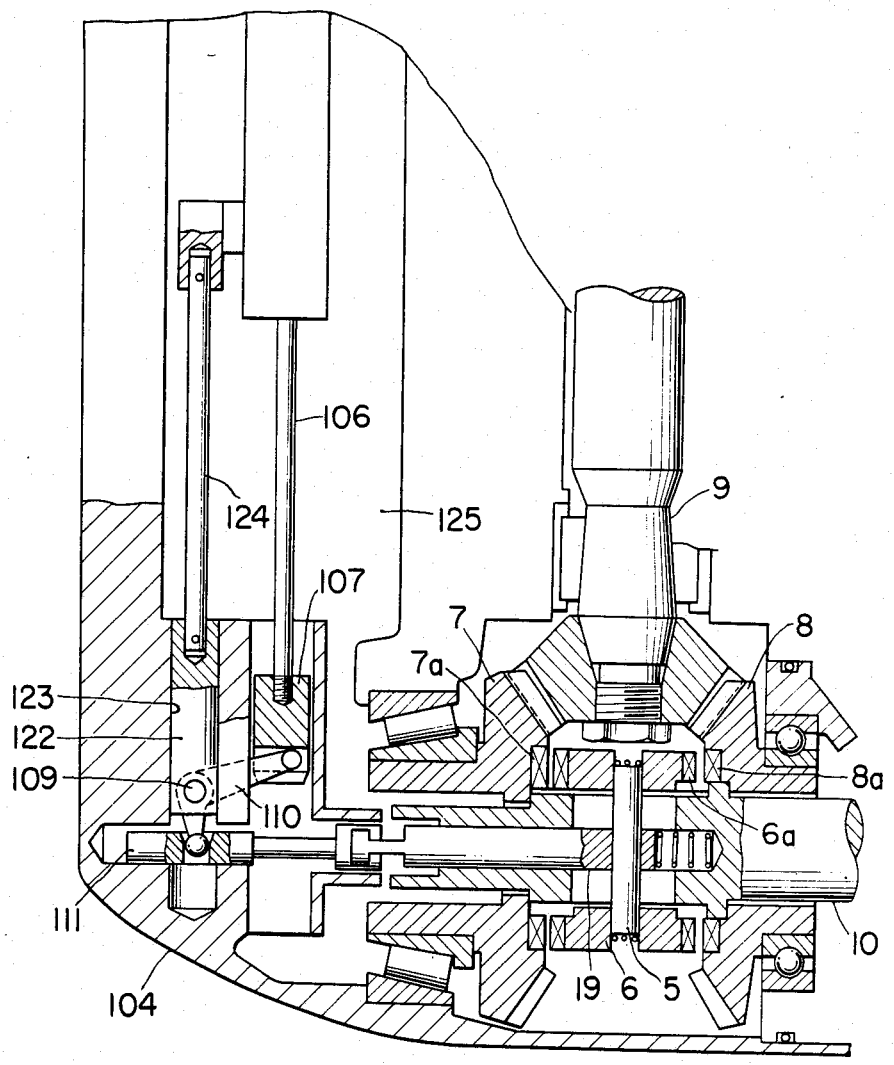
FIG. 8 is a longitudinal sectional view showing a modified shift mechanism.

In a modification shown in FIG. 8, a connector 107 is connected to a lower end of a shift rod 106. The connector 107 is connected to a shift detent 111 through a crank arm 110 pivoted by a pin 109 secured to a pivot shaft 122 disposed in parallel with the shift rod 106.

The pivot shaft 122 is slidably received in an opening 123 formed in a gear casing 104. The pivot shaft 122 is secured to a housing 125 or the gear casing 104 through a pin 124.

With this construction, when the shifter rod 106 is axially and bi-directionally moved in the vertical direction, the shifter detent 111 is reciprocated through the crank arm 110.

The shifter detent 111 is connected to the slide pin 19 so that the reciprocation of the shifter detent 111 causes the same operations as those of the first embodiment.

What is claimed is:

1. In power switching apparatus for an outboard engine wherein a shifter dog is moved by a shift cam to alternatively engage with a forward gear and a reverse gear of a propeller shaft and to disengage therefrom at a neutral position for transmitting the rotation of a drive shaft to the propeller shaft to rotate the same in forward and rearward directions: a clutch mechanism interposed between a shift rod connected to the shift cam and a clutch rod, said clutch mechanism comprising a clutch housing, the diameter of an intermediate portion of an inner opening of said clutch housing being reduced, said clutch housing having large diameter openings at the upper and lower portions thereof, a pair of spring housings respectively disposed in said large diameter openings of said clutch housing, a plunger having large diameter portions at the upper and lower ends thereof fitted in said spring housings respectively, a pair of shift springs interposed between the inner portions of said respective spring housings and said respective large diameter portions of said plunger, locking balls received in openings provided on walls of said respective spring housings, the locking balls being operative to engage with and disengage from grooves provided on the large diameter portions of said plunger, and a detent mechanism for positioning said spring housings at neutral positions thereof corresponding to said neutral position of the shifter dog, whereby said shift cam is moved through said shift springs when said shifter dog alternatively engages with the forward gear and the reverse gear of the propeller shaft, whereas said shift cam is moved integrally with said clutch rod through said spring housings and said plunger when said shifter dog disengages from the forward gear and the reverse gear of the propeller shaft.

2. The apparatus according to claim 1, wherein said shift cam is provided with a slot inclined relative to the axis of the shift rod, and the apparatus includes a slide shifter provided with a cross pin received in said inclined slot for converting vertical movement of the shift rod into reciprocating motion of said slide shifter.

3. The apparatus according to claim 1, including a crank arm for connecting said clutch rod to a slide shifter.

4. A transmission apparatus for controlling the rotation of a propeller shaft of an outboard engine, comprising: a shifter dog shiftable between a neutral condition, a forward drive condition for effecting forward rotation of the propeller shaft, and a rearward drive condition for effecting reverse rotation of the propeller shaft; a shift rod mechanically linked to the shifter dog and axially bi-directionally movable between a neutral location, a forward location, and a rearward location corresponding respectively to the three conditions of the shifter dog for shifting the shifter dog to one of the three conditions in response to the axial movement of the shift rod; a clutch rod disposed along the axis of the shift rod and axially bi-directionally movable between a neutral position, a forward position, and a rearward position corresponding respectively to the three locations of the shift rod; and clutch means for flexibly connecting the clutch rod to the shift rod so as to transmit the axial movement of the clutch rod to the shift rod in the same direction to thereby position the shift rod in one of the three locations thereof, the clutch means including bias means operative when the clutch rod advances from the neutral position to the forward and rearward positions for temporarily biasing the shift rod initially positioned in the neutral location to ensure the corresponding advance movement of the shift rod to the destined location, and lock means operative when the clutch rod returns from the forward and rearward positions to the neutral position for interlocking the clutch rod and the shift rod to enable the shift rod to return to the neutral location in response to the return movement of the clutch rod.

5. A transmission apparatus according to claim 4; wherein the clutch means comprises a first housing fixed to the end of the clutch rod, a second housing fixed to the end of the shift rod and opposed to the first housing, and a plunger interconnecting the first and second housings with each other, one end of the plunger being slidably diposed in the first housing, and the other end of the plunger being slidably disposed in the second housing.

6. A transmission apparatus according to claim 5; wherein the bias means comprises first bias means provided in the first housing, and second bias means provided in the second housing, the first and second bias means being alternatively operative to ensure the respective advance movements of the shift rod.

7. A transmission apparatus according to claim 6; wherein the first bias means ensures the advance movement of the shift rod from the neutral location to the rearward location, and the second bias means ensures the advance movement of the shift rod from the neutral position to the forward location.

8. A transmission apparatus according to claim 6; wherein the first bias means comprises a spring disposed in the first housing, and the second bias means comprises another spring disposed in the second housing.

9. A transmission apparatus according to claim 5; wherein the lock means comprises first lock means provided in the first housing, and second lock means provided in the second housing, the first and second lock means being operative to releasably fasten one end of the plunger with the corresponding housing.

10. A transmission apparatus according to claim 9; wherein the first lock means includes means for releasably fastening one end of the plunger with the first housing when the clutch rod returns to the neutral position from the forward position, and the second lock means includes means for releasably fastening the other end of the plunger with the second housing when the clutch rod returns to the neutral position from the rearward position.

11. A transmission apparatus according to claim 9; wherein the first lock means comprises first lock balls for releasably fastening the one end of the plunger with the first housing, and the second lock means comprises second lock balls for releasably fastening the other end of the plunger with the second housing.

12. A transmission apparatus according to claim 11; wherein the first lock means further comprises a cylindrical housing having a large diameter portion for loosely receiving therein the first housing, a small diameter portion for closely receiving therein the first housing, and wherein the first lock balls are movable between the large diameter portion and the small diameter portion together with the movement of the first housing, the first lock balls being operative when positioned in the small diameter portion to releasably fasten the first housing with the one end of the plunger.

13. A transmission apparatus according to claim 11; wherein the second lock means further comprises a cylindrical housing having a large diameter portion for loosely receiving therein the second housing, and a small diameter portion for closely receiving therein the second housing, and wherein the second lock balls are movable between the large diameter portion and the small diameter portion together with movement of the second housing, the second lock balls being operative when positioned in the small diameter portion to releasably fasten the second housing with the other end of the plunger.

14. A transmission apparatus according to claim 4; wherein the clutch means includes a detent mechanism for temporarily holding the shift rod in the neutral location until the shift rod is moved to the forward and rearward locations.

15. A transmission apparatus according to claim 4; including link means for mechanically transmitting the movement of the shift rod to the shifter dog.

16. A transmission apparatus according to claim 15; wherein the link means comprises a shift cam connected to the shift rod, and a slide shifter connected between the shift cam and the shifter dog.

17. A transmission apparatus according to claim 16; wherein the shift cam comprises means defining a slot inclined relative to the axis of the shift rod, and a cross pin slidably received in the slot and connected to the slide shifter for converting the axial movements of the shift rod into a reciprocating movement of the slide shifter in a direction different than the axial direction of the shift rod.

18. A transmission apparatus according to claim 15; wherein the link means comprises a crank arm connected to the shift rod, and a slide shifter connected between the crank arm and the shifter dog.

19. A transmission apparatus according to claim 18; wherein the crank arm includes a pin for pivotably supporting the crank arm, one end of the crank arm being connected to the shift rod, and the other end of the crank arm being connected to the slide shifter for converting the axial movements of the shift rod into a reciprocating movement of the slide shifter in a direction different than the axial direction of the shift rod.

* * * * *